United States Patent [19]

Borst

[11] Patent Number: 4,610,330

[45] Date of Patent: Sep. 9, 1986

[54] DRIVE-IN MANHOLE STEP CONSTRUCTION

[75] Inventor: Ronald W. Borst, Kansas City, Mo.

[73] Assignee: Clay and Bailey Manufacturing Co., Inc., Kansas City, Mo.

[21] Appl. No.: 634,373

[22] Filed: Jul. 25, 1984

[51] Int. Cl.[4] ..... E04F 19/00

[52] U.S. Cl. ..... 182/90; 411/72; 411/510

[58] Field of Search ..... 182/90, 92; 52/20, 21; 411/57, 60, 70–73, 508–510, 92; 16/383, 384

[56] References Cited

U.S. PATENT DOCUMENTS

| | | | |
|---|---|---|---|
| 4,100,997 | 7/1978 | Peacock | 182/90 |
| 4,195,709 | 4/1980 | Gianotti | 182/90 |
| 4,241,543 | 12/1980 | Foscarini | 182/90 |
| 4,381,633 | 5/1983 | MacLeod | 411/510 |
| 4,393,551 | 7/1983 | Wollar | 411/509 |
| 4,396,329 | 8/1983 | Wollar | 411/510 |

FOREIGN PATENT DOCUMENTS

| | | | |
|---|---|---|---|
| 2254550 | 5/1973 | Fed. Rep. of Germany | 182/90 |
| 2840087 | 1/1980 | Fed. Rep. of Germany | 411/72 |
| 2909294 | 9/1980 | Fed. Rep. of Germany | 411/57 |
| 1391863 | 2/1965 | France | 411/72 |
| 2347560 | 9/1977 | France | 411/72 |
| 2440461 | 7/1980 | France | 182/90 |
| 480551 | 12/1969 | Switzerland | 411/73 |

*Primary Examiner*—Reinaldo P. Machado
*Assistant Examiner*—Alvin Chin-Shue
*Attorney, Agent, or Firm*—Thomas M. Scofield

[57] ABSTRACT

Improvements in plastic coated, steel core reinforced manhole steps; particular improvements in the drive-in or hammer-in ends of a U-configuration manhole step construction, which improvements involve providing resilient, barb-like retainer elements in the drive-in ends yet relieving such in particular patterns so as to enable debris and water in the formed holes in the manhole to escape in order to protect the concrete against conveyed impact pressures and further enable more effective sealing and engagement of the manhole step ends with the manhole wall orifices; particular improvements in drive or hammer-in manhole steps of the plastic coated, steel core reinforced type wherein the drive-in ends of the manhole steps are so relieved in the end portions thereof as to obviate and prevent any sealing of the recesses or holes in the manhole proper; improvements in wedge tooth or barb configuration to achieve maximum pullout resistance while retaining pressure and material relief features.

9 Claims, 9 Drawing Figures

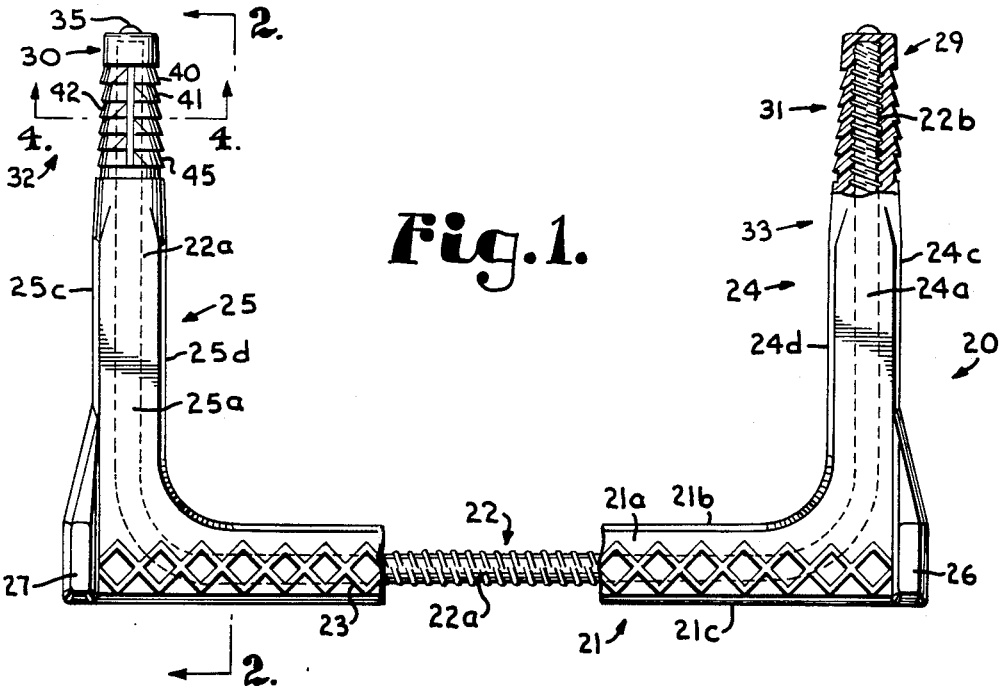
Fig. 1.
Fig. 2.
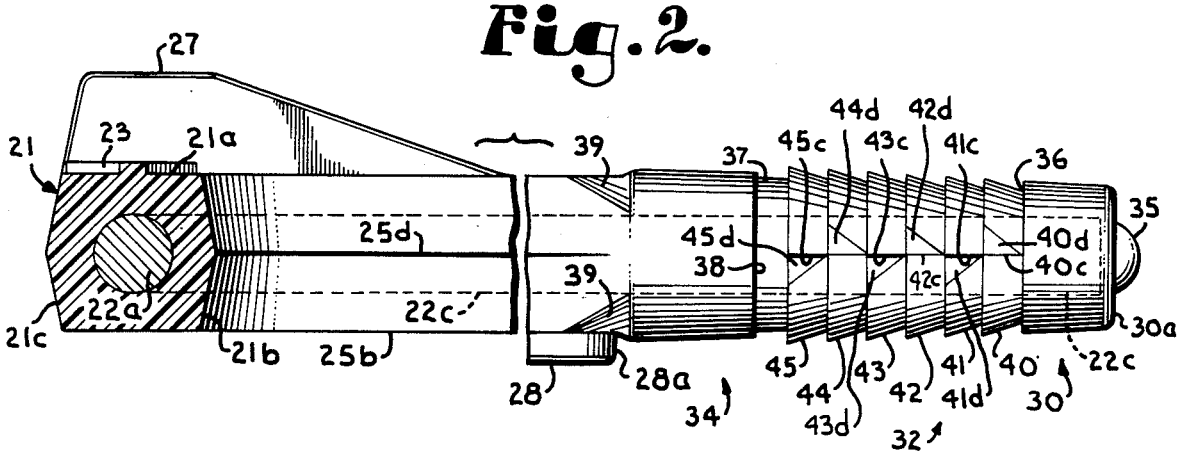
Fig. 3.
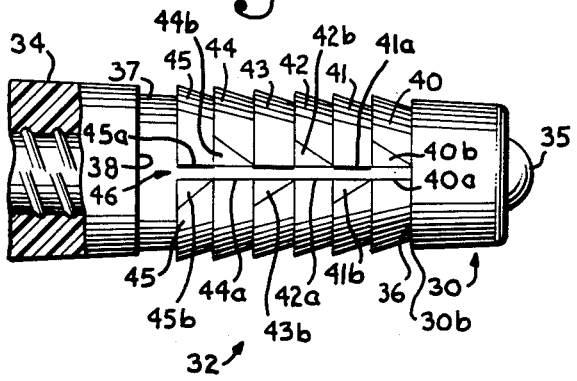
Fig. 4.
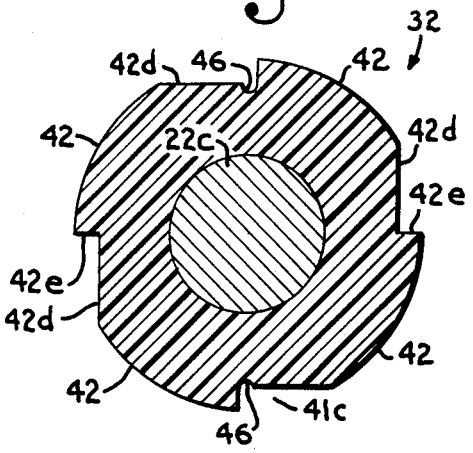

DRIVE-IN MANHOLE STEP CONSTRUCTION

HISTORICAL BACKGROUND OF THE INVENTION

Cast iron manhole steps and ladder rungs have been known to the prior art and industry for decades. As early as 1936, in the patent art, one sees the "wall step" of Grove U.S. Pat. No. 2,064,803 issued Dec. 15, 1936 showing a steel core reinforced manhole step having rubber and cast iron coatings thereon. To the best of applicant's knowledge, the earliest forms of manhole steps were all "cast-in" or "fit-in" types in that, when the manhole itself (or segments thereof) were constructed or cast in the fabricator's yard, the manhole steps were then made or cast integral therewith. Insofar as a manhole or its equivalent would be constructed on site, the steps, ladder rungs or supports would be cast-in at the site or grouted in, in the case of masonry.

About 1969 or 1970 and in the several years following this date, steel core reinforced, plastic-coated, cast-in manhole steps of vaarious configurations were manufactured, offered for sale and sold by M.A. Industries, Inc., a Georgia Corporation of Peachtree City, Georgia. Apparently, at least ten different plastic coated, steel core reinforced manhole steps or types thereof were manufactured, on sale and sold before June 21, 1975 by this company.

On June 21, 1976, by application Ser. No. 698,490, entitled "Step Construction Employing Insertible Fastener Having Deformable Projections", there was filed in the USPTO a patent application directed to a drive-in or hammer-in manhole step construction, this application assigned, as an issued U.S. Pat. No. 4,100,997, issued July 18, 1978, to M.A. Industries, Inc., a Georgia Corporation, having a principal place of business at Kelly & Dividend Road, Peachtree City, Georgia 30269. This assignment is dated Aug. 9, 1983 and is recorded in the USPTO.

On information and belief, (1) at least by June 24, 1975 and very probably earlier, the invention of the Peacock U.S. Pat. No. 4,100,997 patent (but incorporating a steel core reinforcement) was on sale and, further, (2) at least by June 25, 1975 and very probably earlier, manhole steps incorporating the invention of the U.S. Pat. No. 4,100,997 Peacock patent (but incorporating a steel core reinforcement) had been sold, both the offer for sale and sale at least to Waukesha Cement Tile Co., Waukesha, Wisconsin as of the date given.

OBJECTS OF THE INVENTION

A first object of the invention is to substantially improve over the drive-in or hammer-in end plastic coating configuration employed in the commercial steel core reinforced manhole steps of M.A. Industries, Inc. of Peachtree City, Georgia, such improvement particularly also including the disclosure of such an end configuration in U.S. Pat. No. 4,100,997, Peacock despite the latter's nondisclosure of a reinforcing bar associated with the plastic step construction.

Another object of the invention is to provide such improvements in drive-in and hammer-in type manhole step constructions wherein not only is accumulated water (or other liquified materials), but also air pressure within cast manhole step holes in a manhole form both are readily relievable or releaseable over, through and around the drive-in ends of the manhole step legs during the drive-in process.

Another object of the invention is to provide a new configuration pattern for the drive-in or hammer-in ends of a plastic coated, steel reinforced manhole step, wherein rows of massive, strong wedge teeth of individual, discrete character in each row are provided for most positive engagement with the tapered hole, whereby to receive therewithin the manhole step leg ends in more powerful fashion than was heretofore possible utilizing rows of narrow, continuous concentric rings therearound.

Yet another object of the invention is to provide such improvements in configuration of the deflectable engaging members (or wall engaging members) on the drive-in or hammer-in ends of a plastic coated, steel core reinforced manhole step that (1) the engaging elements, being made up of discrete, segmental wedge teeth, not only provide a much more positive, strong and reliable engagement with greater resistance to pull-out, but (2) additionally provide air, water and debris relief and release channels in order to enable more effective engagement by the step leg ends of the prepared tapered holes for such steps and thus minimize damage to the concrete of the manhole in the step hammer-in process.

Still another object of the invention is to provide such new wall engaging structure with respect to the drive-in or hammer-in ends of a steel core reinforced, plastic coated manhole step that (1) the entire length of the drive-in ends or elements of the step legs are vented for pressure and relief of any accumulating air pressure and/or liquid materials which may be present in the prepared holes for the manhole step ends and, (2) yet further, additionally provides much more powerful wall engaging elements of rows of discrete multiple wedge tooth configurations, which, when the device is once driven in and in place, far more greatly resists pull-out than any known device.

Other and further objects of the invention will appear in the course of the following description thereof.

DESCRIPTION OF THE DRAWINGS

In the drawings, which form a part of the instant specification and are to be read in conjunction therewith, embodiments of the invention are shown and, in the various views, like numerals are employed to indicate like parts.

FIGS. 1–4 inclusive show a first form of the subject improvement.

FIG. 1 is a vertical plan view from above of an entire manhole step incorporating a first form of the subject manhole step engagement end improvement, this figure cut-away centrally of the bottom portion thereof to show the reinforcement bar within the plastic coating or sheathing, the view also in section at the upper right end thereof to illustrate the location of the extreme end of the deformed reinforcement bar, such reaching almost to the end of the drive-in leg end portion.

FIG. 2 is a view taken along the line 2—2 of FIG. 1 in the direction of the arrows with the view enlarged and somewhat condensed in the showing.

FIG. 3 is an enlarged fragmentary view of the upper left hand corner of FIG. 1 showing the detail of the drive-in end of the manhole step leg. A portion of the inboard shoulder is cut away to show the presence of the rebar therein.

FIG. 4 is a view taken along the line of 4—4 of FIG. 1 in the direction of the arrows.

FIG. 5 is an enlarged fragmentary side view of the the right hand side of the free end of the left leg of the step of FIG. 1, looking to the left in the FIG. 1 view, but showing a somewhat modified end construction from that of the views of FIGS. 1–4, inclusive.

FIG. 6 is a top (equivalent to the view of FIG. 1) view of the leg end of FIG. 5 showing details of the pressure relief and drain canals or grooves positioned inboard and outboard of the intermediate wedge tooth section.

FIG. 7 is a view of the underside of the leg of FIGS. 5 and 6 showing the pressure relief and drainage channels running from the free end portion of the leg to and including the stop.

FIG. 8 is an end view of the leg of FIGS. 5–7, inclusive looking from right to left in the view of FIG. 6.

FIG. 9 is a view taken along the line 9—9 of FIG. 5 in the direction of the arrows.

FIGS. 1–4, INCLUSIVE

Figure 5:
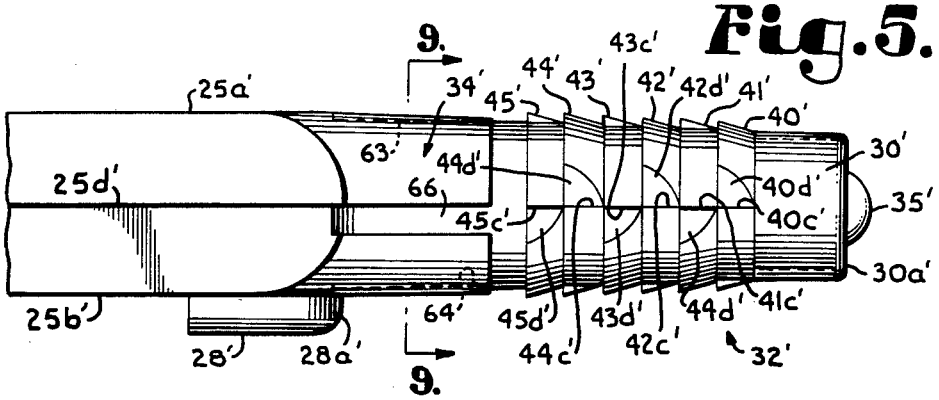
FIGS. 5–9 inclusive show enlarged detail leg end drawings of a second form of the subject improvement.
Figure 6:
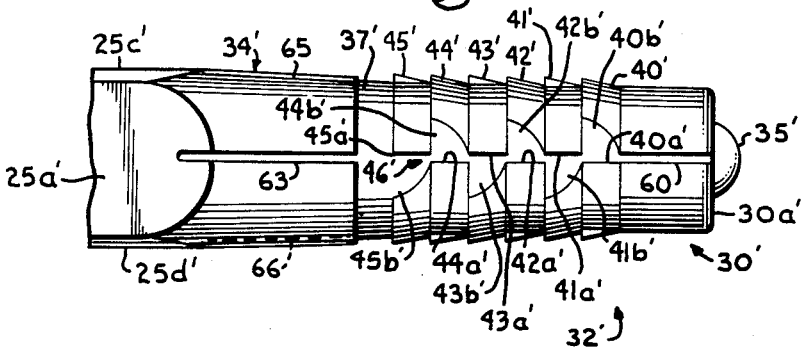

Referring first to the improvement seen in FIGS. 1–4, inclusive, the manhole step in question is generally designated 20. It has an outboard (with respect to the manhole or other wall supporting this step in use) step portion generally designated 21, such step portion having a top wall 21*a*, an inboard wall 21*b*, an outboard wall 21*c* and a bottom wall 21*d*. Received within the plastic outer sheath or coating generally designated 21 is the base 22*a* of a U-shaped, deformed reinforcement bar generally designated 22 and having inwardly or inboardly extending, toward a manhole wall, free ended legs 22*a* and 22*b* formed integrally therewith. Legs 20 and 25 extend outwardly from step portion 21. On the top surface 21*a* of the step plastic coating 21 there is formed a raised, continuous repeating diamond shape friction member 23 which preferably extends the length of the step element 21 on the top surface thereof.

Looking at FIG. 1, the right hand formed plastic leg element is designated 24 and the left hand formed plastic leg element designated 25. These leg elements, in the outboard portions thereof, have flat upper surfaces 24*a*, 25*a*, flat lower surfaces 24*b* (not seen), 25*b*, outer sides 24*c*, 25*c* and inner sides 24*d*, 25*d*. The sides 31*c*, 21*b*, 24*c*, 24*d*, 25*c* and 25*d* are preferably not flat, for mold separation purposes, each such being outwardly angled to a center line along each face thereof. Polypropylene is a suitable plastic.

Suitable end safety flanges 26 and 27 are provided connected to the ends of the molded foot receiving step portion 21, such also extending on the sides of each of the legs 24 and 25 at the outer faces thereof. Stops 28 (only one seen, in FIG. 2) are provided on the free end lower walls 24*b* and 25*b*, such terminating inwardly just short of the end tapered pieces to be discussed.

What has essentially been heretofore described is the well known prior art construction or structure of a manhole step construction comprising a U-shape, strong metal reinforcing bar having molded thereover an integral plastic configured step and supporting leg U shape, the latter fully enclosing said bar to make a composite, yet integral, plastic coated, steel core reinforced manhole step body. This body has elongate, basically straight step portion 21 at the base thereof (U base) with two substantially like and symmetrical leg support members 20 and 25 extending at substantial right angles from the ends of step portion 21 in the same direction and at least substantially parallel to one another. Still staying in the prior art, but passing to portions of the device not yet described, the free outer ends of the leg support members 24 and 25 are adapted to being driven or hammered into paired, spaced apart, inwardly tapered, formed holes in a manhole or like wall. Such wall may be concrete, reinforced concrete or other suitable material. The said free outer ends have three separate, adjacent zones formed thereon, said zones including, moving from the outermost free ends inwardly toward the step portion:

(a) Outermost, slightly frusto-conical end pieces generally designated 29 and 30, (b) Intermediate, somewhat recessed, outwardly tapered leg portions having deflectable wall engaging members thereon, such leg portions generally designated 31 and 32 and (c) Innermost, outwardly tapering shoulder portions generally designated 33 and 34.

Considering the details of these zones individually, from the outermost portions of the free ends of the support members or legs inwardly, the following may be noted. (The particular improvement of FIGS. 1–4, inclusive is in the structure and function of the deflectable wall engaging members on leg portions 31 and 32.) First, the details of the frusto-conical end pieces 29 and 30 may be seen in FIGS. 3 (top view) and 2 (side view). Referring, then, to member 30, at its outboardmost flat end 30*a* there is preferably provided a hemispherical knob or tip 35 which, if the formed hole in the manhole wall is short (or blocked at the end with material) tends to bottom out first and flatten out to enable further hammering in of the leg support member in question.

The frusto-conical members 29 and 30 enlarge diametrically slightly, moving from right to left in the views of FIGS. 2 and 3 and there is provided a first, small initial wall engaging flange 30*b* at the inboard (toward the step) endof member 30 and a like flange (not seen) for member 29. Such flange is preferably interrupted at several points around the periphery thereof. As may be seen in FIG. 2, as well as FIG. 1, the rebar ends of outwardly extending portions 22*b* and 22*c* thereof closely approach (preferably within $\frac{1}{8}$ to $\frac{1}{4}$ inches of) the ends of members 29 and 30.

Moving to the left in FIGS. 2 and 3, the base wall 36 of the intermediate, recessed, outwardly tapered leg portion 31 is first seen, then the rows of wedge tooth segments formed or molded thereon, the outermost portion thereof appearing at 37 just before shoulder 38. The latter defines the outermost end of the innermost, outwardly tapering shoulder portion 34. The shoulder portions 34 and 33 are round in transverse section and extend back to outwardly flaired portions 39 best seen in FIG. 2. The latter transform the substantially circular vertical section (through the shoulder portions 34, 33) to a substantially square or rectangular section inboard (toward the step 21) thereof. With respect to the portions of legs 20 and 25 extending from step 21 to zones 33 and 34, as previously mentioned, preferably, the top and bottom surfaces of the legs are truly flat, while the side (inside and outside) surfaces of leg support members 24 and 25 are beveled outwardly. Also beveled are the side, near vertical surfaces 21*b* and 21*c* of the step portion 21, the top and bottom surfaces of the latter being typically flat. The diamond step pattern is raised from surfaces 21*a*.

In a specific (but not limiting) example of the length of the three part tapered end, the total length from the outboard face 30*a* of member 30 to the outboard face 28*a* of stop 28 is approximately 3½ inches. The knob or tip 35 is approximately ⅛ inch in height. The length of end frusto-conical member 30 is approximately half an inch, or slightly greater. From the inboard shoulder of member 30 to shoulder 38 is slightly greater than 1¾ inches and the length of shoulder portion 34 is slightly greater than 1¼ inches, from shoulder 38 to the outboard face of stop 28.

Everything described so far with respect to this model, with the exception of the wedge tooth segments (to be described) on the tapered intermediate portion 31, 32, is entirely conventional. This is, if such is not entirely coventional with respect to the M.A.I. prior uses (and surface configuration of the pure plastic manhole step disclosure of Peacock U.S. Pat. No. 4,100,997) then such is conventional with respect to applicant's assignee's first commercial model of plastic coated, steel core reinforced hammer-in or drive-in manhole step utilizing concentric rings in zones 31 and 32 as deflectable wall engaging members, in the manner taught by the external surfacing of such zones seen in Peacock U.S. Pat. No. 4,100,997.

The improvement provided with respect to the particular manhole step shown in FIGS. 1–4, inclusive is the provision of particular deflectable wall engaging members comprising a plurality of rows (here seen as 6) of wedge teeth segments. Such are provided on the said intermediate, recessed, outwardly tapered leg portions 31 and 32 between the outermost, frusto-conical end pieces 29, 30 and the innermost, outwardly tapering shoulder portions 33, 34. The individual, adjacent wedge tooth segments are separated from one another, in each row thereof, at four positions, first, on the substantial centers of the tops and bottoms of the said intermediate leg portions 31, 32, in positions substantially 180° opposed to one another and, secondly, in two positions substantially 90° laterally displaced from the first mentioned separations, at the substantial center of the opposed sides of said intermediate portions. The latter are in line with the mold parting lines at the apex of the bevels on sides 24*c*, 25*c* and 24*d*, 25*d*.

Looking down on the top of zone 32 in the left hand section of FIG. 1 and the enlarged fragment of FIG. 3, sequential rows of segments (wedge tooth segments) are numbered 40–45, inclusive moving from the outer end of the legs rearwardly or backwardly toward the step 21. Vertical end walls of the segments (radially outwardly extending) are numbered 40*a*, 42*a* and 44*a* in the view, particularly, of FIG. 3. Beveled flat ends of segments in successive axial line with the latter are numbered 41*b*, 43*b* and 45*b* in the view of FIG. 3. Adjacent beveled flat ends of adjacent tooth segments 40*a*, etc. in the same rows are numbered 40*b*, 42*b*, etc. The vertical walls opposite bevels 41*b*, 43*b*, etc. are not numbered but are opposed thereto in a given row and offset staggered axially re walls 40*a*, etc.

The groove, channel or passageway created down the length of intermediate portion 32 (by offset stagger from the top center line of successive walls in successive rows) is generally designated 46 and is the continuation of the outwardly tapered surface 36, 37 of zone 32 therewithin. Said otherwise, groove or channel 46 runs flat (but rising) from zone 36 to zone 37 and from the inner end of member 30 up to wall or shelf 38. It should be noted that both the walls 40*a*, 42*a*, etc. and the ends of the bevels 40*b*, 42*b* which oppose same are displaced from one another the width of the groove. This makes a distinction between the pressure relief channels on the top and bottom of the zones 31, 32 (where there is a groove as at 46 present between the walls and bevels) and the pressure relief channels provided at the sides of zones 31 and 32 (FIG. 2) where there is no groove between the walls and the bevels and the channel is zigzagged or staggered down the line therebetween. (See FIG. 7 for a view of the underside of the tapered end in a variation changing only zones 30 and 34.)

Looking, then, at the center line pressure relief channel in the zone 32 of FIG. 2, one series of walls 40*c*, 42*c* and 44*c* is seen opposed to bevels 40*d*, 42*d* and 44*d*. Interleaving or axially spaced between these sets of walls and bevels, which are on the same side of the center line, there are the reverse sets of walls 41*c*, 43*c* and 45*c* opposed by bevels 41*d*, 43*d* and 45*d*.

Since there are four teeth in a given row 40, 41 etc. and since there is a groove on each of the top and bottom sides (like groove 46 in FIG. 3, also see FIG. 7 for a representation of the opposite side groove) each tooth ends, at one end thereof, in a groove. The respective tooth ending at a groove may be a wall or a bevel. Thus the individual teeth are not quite 90° segments.

The distinction between these two pressure relief passage structures is best seen in FIG. 4. Despite the absence of a groove on the sides of the tapered intermediate portions 31 and 32 at the center lines, because each wedge tooth segment (comprising a substantial 90° arc with a radially vertical wall at one end thereof and a bevel at the other) starts with its axially lowest base portion next to the axially highest extension of the axially preceding wedge tooth segment and further since bevels and walls alternate across the center line, there is a zigzag passage for pressure relief which for example, begins in the bevel 40*d*, centrally flat from wall 36, then passes over the base of wall 41*c* (at its outer lowest point) into bevel 41*d*, thence over the outer lowest portion of wall 42*c* into bevel 42*d*, etc.

Operation of FIGS. 1–4 Device

Stops 28 prevent the driving or hammering in of the tapered ends of the manhole step legs therepast. Tapered holes may be formed in conventional manhole walls or any ladder rung bearing walls in various manners. One such way is seen in the United States Patent to Craig B. Williams U.S. Pat. No. 4,365,780, issued Dec. 28, 1982, for "Removable Insert For Forming Holes In Concrete And The Like". The point is to provide a precisely sized, shaped and inwardly tapered opening which will adequately and properly permit the effectual engagement of the tapered ends of these drive-in or hammer-in manhole steps within such holes.

The structure of the tapered holes determines the necessary structure of the tapered ends or vice versa. That is, the tapers of frusto-conical members 29 and 30 essentially match and align with the tapers of the innermost, outwardly tapering shoulder portions 33 and 34. Said otherwise, the lines of taper of the frusto-conical end pieces 29 and 30 preferably, when extended, lie along the lines of taper of the innermost shoulder portions 33 and 34. With respect to this, reference to Peacock U.S. Pat. No. 4,100,997, FIGS. 2 and 3, indicates that Peacock's taper of the outer end members (apparently cylindrical as shown as in those views) does not match the shoulder taper, which shoulders are forward of the lead lines of numberals 10 and 18 in the views of FIGS. 2 and 3 (and is shown engaged in a tapered opening.) Certain of the "shop drawings" above mentioned of M.A. Industries, Inc. and actual models of the M.A.I. drive-in manhole steps in applicant's assignee's hands appear to show the outboard member tapering not seen in the Peacock patent disclosure.

The zones 31, 32 or, at least the base floors thereof, are recessed below the lines of taper of the end pieces 29 and 30 and inner shoulder portions 33 and 34. If the wedge teeth 40, etc. were not provided thereon, hammering in of the tapered ends of the manhole steps into a preformed tapered hole would cause engagement only at the end pieces and tapered shoulders.

However, integrally formed on or molded on the intermediate portions 31, 32 are the rows or sets of wedge teeth of the character previously particularly described. The inner (toward the step) terminal edge of each wedge tooth stands above the slope or taper lines extending between the end pieces and shoulder portion. Thus, since floor positions 36, 37 of the intermediate portions 31, 32 taper toward the step at a slope equal to the taper of the end pieces and shoulder portions, each of the engagement edges of each of the wedge teeth extend thereabove for wall engagement.

Because these wedge teeth engaging edges (as was and is the case with respect to limited concentric ring structures of the M.A.I. actual prior drive-in and hammer-in uses) all extend above the line of taper, they effect the first engagements with the like tapered inner surfaces of the formed receiving holes in the manhole or other wall. It is important to note that, if radially spaced reliefs of the rows or sets of wedge teeth were not provided as in the subject improvement, then, as the tapered ends of the step were driven into the holes, an immediate sealing of the holes would be effected when the edges engaged the wall hole inner surface. This is the case in the continuous ring of forms of the prior art. This is extremely undesirable as important goals of the subject improvement include:

(1) To release, not build up, any air pressure ahead of the wedge teeth (ane drive-in step ends) in the dead end tapered holes in the manhole wall;

(2) To provide access for exit of water or liquid materials from the depths of the tapered hole (if such are present) so that (a) the tapered ends may fully be driven into the tapered holes and (b) hydraulic pressure and shock and resulting damage therefrom not be created, transmitted into or effected in the concrete structure so as to injure the manhole, the tapered hole itself or even penetrate or puncture the manhole wall.

(3) To provide the strongest, least reversible and most difficult pull-out possible to obtain by utilizing uniquely shaped and the strongest possible deflectable wall engaging members of discrete tooth form.

Because of the presence of the hemispherical member 35 leading into the hole, also the taper and initial clearance of end pieces 29 and 30 in initial movement of the step ends into the prepared holes (while the wedge tooth engaging edges make first wall engagement for the reasons previously described) and because of the only later contact and final circumferential wedging of the wall against the shoulder portions 33, 34, the first two goals are quite effectively accomplished with the FIGS. 1–4 structure. Certainly they may be more effectively accomplished than with the monolithic ring structures known to the prior art for hammer-in and drive-in manhole steps. That is, air pressure relief and bypass of fluid and liquid materials the length of the tapered end portions may occur during the entire drive-in process until there is a complete circumferential wedging of the end pieces 29 and 30 and the shoulder portions 33 and 34 against the inner hole wall, if such occurs. Since this does not and cannot occur until the step leg tapered ends are driven to or very almost to the leading edges of stops 28, in effect, applicant has discovered that relieving and segmenting the rows of wedge teeth alone, as shown and described, adequately prevents total blockage by any part of the tapered ends until full bottoming out is accomplished. Even then, because of the massive character of applicant's wedge teeth, their more difficult deformation than the slighter and more easily deflectable rings of the prior art and their retention of their pressure and fluid relief passages even under full drive-in deformation, there is an extremely strong tendency to avoid and prevent passageway sealing in the drive-in process clear down to and including ultimate full seating of the tapered leg ends in the tapered hole walls. Accordingly, this construction strongly tends to avoid and prevent any dangerous pressure buildup and air or hydraulic shocks and damage in the tapered holes during the entire drive-in process.

The strength and power of the wedging and siezing action of wedge teeth 40–45, inclusive (the rows thereof) is far greater than the smaller, discrete rings employed in the prior art M.A.I. uses (approximating the ring constructions disclosed on the outer surface of the pure plastic manhole step of Peacock U.S. Pat. No. 4,100,997). The simple and evident reason for this may be seen in the fact that the subject wedge teeth, in the successive rows thereof, are integral, outwardly tapered bodies extending, in their rising taper, from the terminus of the prior wedge tooth outwardly to the respective end of the tooth in question. Thus, from the near 90° (always somewhat less, because of the bevel at one end of each wedge tooth, etc.) arcuate segment making up each wedge tooth of each row of four, the entire axial intervals or spaces (except for the bevels and the grooves) along the intermediate portions 31 and 32 between zones 36 and 37 are devoted to the outwardly tapering, monolithic,- integral, inclined wedge tooth constructions whereby a far greater mass of tough plastic material is incorporated into each wedge tooth body than is or makes up in any comparable segment of a shallow ring as seen, for example, in Peacock U.S. Pat. No. 4,100,997. The slope of the wall resisting pullout is also much flatter that the angled or arcuate short ring walls of the prior art devices.

Once the manhole step is hammered in, with the outer edges of the wedge teeth 40–45 (all members of each group, row or set) deformed inwardly from engagement with the tapered hole inner wall and such strongly resiliently pressing back thereagainst with the sharpened end edges thereof, in order to pull out the manhole step, such engaged wedge teeth must be reversed in deflection. In insertion, the teeth ae naturally more (relatively) easily deflected because of the facing of the barbs away from the direction of drive-in. However, on pull-out, the barbs are facing in the direction of pull-out and must be reversed or pulled back over themselves to enable such. One can easily see from comparison of the massive structures and quantities of material in applicant's wedge teeth 40–45, inclusive (compared to the minimal materials in comparable segments of the fragile rings 28 of Peacock 997) that applicant's wedge tooth structural improvement is massively stronger in pull-out resistance.

Thus it may be seen that applicant's improvement wedge tooth construction, localized in the zones 31, 32, operates not only to minimize or prevent any sealing of the interior portion of the tapered receiving wall opening or hole, but also enables release and escape of air pressure and fluid materials therefrom, as well as providing rigorous and unique anti-pullout capacity and ability. The provision of pressure relief channels at the symmetrically displaced four positions around the tapered zones 31 and 32 makes sure that inadvertent asymmetries of the cast hole structure do not hinder pressure relief and material relief. At the same time, by having only four reliefs, the main masses of the wedge teeth are present to give massive, strong gripping of the manhole wall, again despite variances of perfect hole shape.

Yet another point can be made in contradistinction to the prior art continuous, circular rings. Specifically, if one portion of a circular ring fails or is overridden in pullout, the tendency is for the entire ring to fail or be overridden or reversed in pull-out. The contrary is the case with respect to applicant's discrete, separate wedge teeth. Failure of one or more wedge teeth in a radial row or axial line thereof line or asymmetric engagement of such due to improper hole formation does not automatically extend into adjacent zones because of the separation of individual wedge teeth, one from the other, in a given row, as well as their massive structure.

FIGS. 5–9, Inclusive

Referring to FIGS. 5–9, inclusive, this group of figures shows the drive-in end of a leg support member which is identical in all ways to the drive-in end seen at the left in FIG. 1, to the right in FIG. 2 and in FIGS. 3 and 4, save for the following additional changes:

(1) A pair of pressure relief passages 60 (top) and 61 (bottom) are provided running the length of the center top and bottom surfaces of frusto-conical end members 29 and 30 of the device of FIGS. 1–4, inclusive;

(2) Four pressure relief channels are provided in the innermost, outwardly tapering shoulder portions 33, 34, two of them grooves 63 (top) and 64 (bottom), the other two being side bevel reliefs (upwardly) 65 and (downwardly) 66. The bottom groove 64 further has a vertical relief 67 connected thereto at its inboard end (with respect to the step 21), such positioned in the front face of stop 28. (It must be understood that the ends of each leg 24 and 25 are identical in structure.)

Everything else in the manhole step constructions which carry the tapered end(s) construction(s) of FIGS. 5–9 are identical to the FIGS. 1–4 showings, as above stated. This includes the wedge tooth structural arrays in zones 31, 32.

Figure 7:
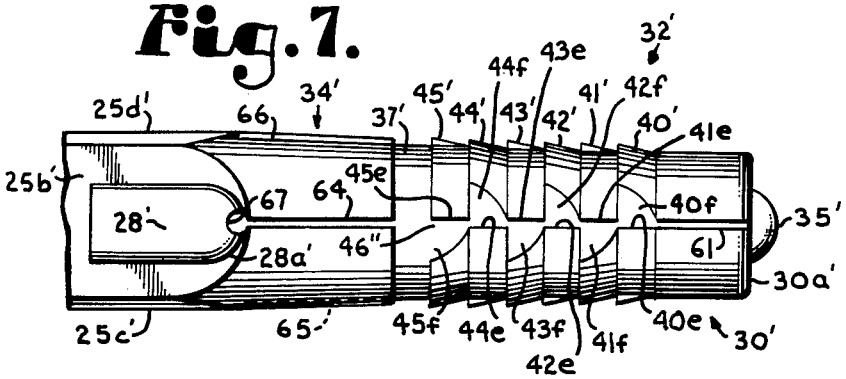
Figure 8:
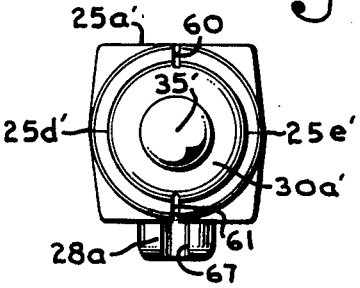
Figure 9:
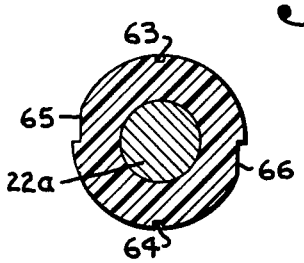

Since all of the parts in FIGS. 5–9, inclusive are identical to those seen in FIGS. 1–4, inclusive save for the above noted additions of further pressure relief means, such common parts are numbered the same in the views of FIGS. 5–9, inclusive, but primed. On the other hand, since the underside of the end drive-in portion of the leg support member 25 is not seen in FIGS. 1–4, inclusive, the detailing of parts of the wedge teeth on that other side in FIG. 7 are numbered the same, but with different letters, thus to fuly and properly designate the walls and bevels of the groove 46' of FIG. 7.

Since only one leg terminus is detailed in FIGS. 5–9, inclusive, it should be pointed out that an identical duplicate of the leg end seen in FIGS. 5–9, inclusive (which is shown as the equivalent of the tapered leg end 30, 32 and 34 to the left in FIG. 1 and also seen in FIGS. 2–4, inclusive) is provided on the other leg end, as at 29, 31 and 33, seen in the right hand side of FIG. 1.

Because of the imperfection of hole formation, warpage of cast concrete and the like, applicant, in addition to providing the strong, pressure and seal relieving wedge tooth construction of FIGS. 1–4 in the zones 31 and 32, additionally decided to more positively and surely extend and insure the air pressure relief and fluid and material relief features of the construction of FIGS. 1–4, inclusive into the entire tapered step leg end structure. In other words, although the desired results set forth above were achievable by the FIGS. 1–4 structure in properly prepared, cast holes of non-anomalous character, additional insurance of achievement was developed. Such effect is universally effected and accomplished by providing the paired relief grooves, channels or passages 60, 61 in end frusto-conical elements 29' and 30' (corresponding to 29 and 30) and the four pressure relief channels 63–66, as well as the vertical channel 67 in stop 28' on the innermost, outwardly tapering shoulder portions 33', 34'. One may alternately provide either the reliefs of the end members alone or the shoulder portions alone, but both are preferred. In any case of the three noted options, the wedge tooth construction of FIGS. 1–4 is critical in zones 31, 32.

With respect to channels or grooves 60 and 61, it should be noted that they are axially in line with the grooves 46' and 46'', respectively, through the wedge tooth peripheries centrally of the tops and bottoms of the leg ends. Thus, a complete, extensive groove system is provided clear from the free ends of the terminus of the tapered shoulder portions 33', 34' by virtue of the top and bottom grooves 63 and 64 which are in line with the previously mentioned grooves. Grooves are not required, of course, at the beginning zones 36 and end zone 37 of the intermediate recessed portions 31', 32', as these are already recessed.

While optional beveled relief passages or grooves could be provided on the outermost frusto-conical members at the sides of the said members 29' and 30', such are not shown, as experience has proven the relief grooves 60 and 61 are sufficient. If such were provided, they would be analogous to beveled relief channels 65 and 66 to be heredescribed.

Looking at FIG. 5 first, it may be seen that a flat beveled surface 66 is provided on the inner face of leg 25 the defining wall of which is axially in line with the last wall **45*c'* of the zigzag pressure relief channel on side 25*d* of leg 25**.

On the opposite side of the leg, there is provided an upwardly beveled (66 was downwardly beveled from the centerline) recess 65 which continues the zigzag pressure relief channel on that side. Thus four passages or channels may be provided, two beveled reliefs (on the sides) and two grooves (on the top and bottom), whereby full outer access of air pressure and fluids, water, etc. is provided even down to and including seating at full depth. Thus, the middle steps in question may be driven in with great force and rapidity to full seat without any concern that overpressurization or damage to the concrete, break down or puncturing thereof of the manhole wall or any part thereof will occur. At the same time, the extremely powerful engagement of the barb members 40'–45', inclusive, the rows or sets thereof, remains to supply the extremely powerful anti-pullout action and capability.

It perhaps should be commented that, where drilling of cylindrical holes is required for repair of manholes or manhole sections on the job (with no tapered drill available), no type of manhole step tapered end will have as effective an engagement in such uniform diameter hole as within a tapered hole.

General Considerations

Typically, manhole walls may be of almost any thickness, generally running from 4 to 8 inches. The insertion of the tapered ends of these manhole steps thereinto is approximately $3\frac{1}{2}$ inches. The holes cast in the manhole section are typically approximately $3\frac{3}{4}$ inch deep. In "thin" manhole walls, for example 4 to 5 inch thickness, it can be seen easily that hydraulic ram pressure could crack, break out or puncture the manhole walls, which result is very much against specification.

The basic purposes of the channels provided in the wedge tooth rows in FIGS. 1–4, inclusive and the additional channels provided axially inboard and outboard thereof in the end frusto-conical members and tapered shoulder portions are to, first, relieve air and hydraulic pressure within the holes during drive-in to prevent damage to the manhole wall and, secondly, enable the removal or drive-out of water or other materials which may have been received in the manhole wall cast holes during storage or transport thereof. Should there be a seal of the cavity during drive-in of the step leg ends, and water or other fluid, materials, mud or the like be present therein, the driving in of the tapered end, without proper structural pressure relief provisions, can act exactly like an hydraulic ram and even break out or push through the wall of the manhole. Alternatively, such action may exert unusual pressure on the concrete within the hole, fracturing such or injuring it. The latter would prevent the desired optimum grab of the wedge teeth on the wall. Yet additionally, by providing channels and spaces for air pressure and material relief and removal, it is insured that, assuming the manhole receiving openings or passages are formed correctly, the manhole step ends may be fully driven into the holes to get full attachment and engagement thereof.

While manholes or manhole sections may be cast on the job, most are cast in segments and, after cure, transported to the job. The manhole shape, size, etc. is typically specified by the city or engineer for the job in question. With respect to providing the tapered holes in the manhole or manhole segments, the greatest majority are cast as the manhole is formed or poured.

Thd drive-in or hammer-in manhole steps are not driven into the manhole walls shortly after pouring of the concrete because the concrete needs curing time to set up to the desired tensile strength. Driving the steps in early would bruise and deform the concrete. The steps are typically driven in just before or after transport. There may be manhole configurations with offsets and straight, flat portions, as well as the customary arcuate segments.

Typically, drilled holes are utilized only for repairs. A one inch diameter hole is driven or drilled in the wall section. These holes are not tapered, unless a tapered drill is provided (unusual). Straight holes do not give anywhere near the pullout results compared to tapered holes in any tapered end step construction.

The subject wedge tooth construction gives a much better grab and has far superior pullout strength compared to any of the prior art ring configurations, including applicant's assignee's original ring form manufactured and solid. This is primarily because of two basic reasons. First, excessive deformation of a portion of one of these wedge teeth does not necessarily excessively deform or damage the other wedge teeth in the same row. This is typically not the case with continuous rings, per se. Secondly, the relative massive quantity of material that is incorporated in the subject wedge tooth construction (as compared to the ring construction of the prior art), as well as the lesser taper in the backup wall of the tooth gives a far greater force and power in engagement (grab and resistance to pullout). Said again, one of the wedge teeth or barbed sections of the subject device in a given row may yield or be drastically deformed because of some unusual event or condition within the receiving manhole wall orifice, while the others of the same row or successive rows with respect thereto do not. If all parts of the wedge teeth in row were connected (a continuous ring employed) all or excessive portions of the ring might give or be effected by the condition. The subject wedge teeth also, because of their flatter outer surface, also more strongly deform outwardly onto a sloping opposed surface in a manner which gives more support. More material of the subject wedge teeth is deformed under compression and at a different angle than the right portions of the prior art. This gives greater back pressure and holding force.

In drive-in of the subject manhole step, into a tapered hole, the wedge teeth deform in one direction, according to their taper. In order to be removed from the hole, they must deform in the other direction. However, the heavy masses of the separate wedge segments and the flat wedge form, per se, fight reverse deformation to the greatest degree, thus giving the enhanced pull-out resistance.

It is also noted that, with the powerful, massive wedge teeth constructions of this disclosure, if such were continuous (rings), immediate, very effective sealing might be encountered in drive-in and thus greater need for pressure and material relief and release would be called for or required.

It should be understood that (1) the slope of the non-grooved outer surface of the frusto-conical members 30, 30' (or truncated cone member 30, 30'), (2) the slope of the base of the recessed barb carrying portion running from 36 to 37 (up to wall 38 from wall **30*b*), such slope exemplified in the floor of groove 46 and, finally, (3) the slope of the ungrooved shoulder portions 34 are most preferably all the same. A typical example is a slope from axial on each side of each of these zones of two degrees and 23 minutes. This means that the line of the ungrooved outer surfaces of the frusto-conical member 30 and the shoulder portions 34 are in continuous line with one another. Actually, the groove floors of grooves 60, 46' and 63 (also 61, 46'' and 64**) are in continuous line with one another, also, same taper.

The recess of the base of portions 31, 32 is approximately 1/32nd of an inch from the members 30 and 34 adjacent outer diameters. The depth of the grooves 60, 46' and 63 is 1/32nd of an inch and the width of the grooves is 1/16th of an inch, preferably. Thus the floors of the grooves are continuous and tapered parallel to taper of the outwardly placed tapered portions of members 29, 30 and 33, 34. The outward extension of the six main barbs 40–45, inclusive past the extended line of taper from the inboard and outboard members (for example, 30 and 34), with respect thereto, is preferably 1/32nd to 1/16th of an inch. The angle of the barbs from axial is preferably around 17° and 35 minutes.

Given a diameter of the free end of frusto-conical member 30, 30' of from 0.890 to 0.900 inches, the rest of the dimensions essentially follow, given the tapers, angles depths and recesses. The shoulder bevels are typically 1/32nd inch deep and 3/16th wide.

The foregoing are typical examples of dimensions only and are not to be interrupted as limiting.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a manhole step construction comprising a U-shape, strong metal reinforcing bar having molded thereover a configured step and supporting leg U shape fully enclosing said bar to make a composite, yet integral, plastic coated, steel core reinforced manhole step body, said body having an elongate, basically straight step portion at the base thereof with two substantially like and symmetrical leg support members extending substantially parallel to one another and at substantial right angles from the ends of said step portion, the free outer ends of said leg support members being adapted to being driven or hammered into paired, spaced apart, inwardly tapered, formed holes in a wall and having three separate, adjacent zones formed on the free ends thereof, said zones including:

(a) an outermost frusto-conical end piece having an inner base, (b) an intermediate, recessed, outwardly tapered leg portion having deflectable wall engaging means thereon and (c) an innermost, outwardly tapering shoulder portion, the improvement which comprises the deflectable wall engaging members comprising a plurality of rows of wedge teeth segments provided on said intermediate portion between said outermost frusto-conical end piece and said innermost outwardly tapering shoulder portion, individual wedge teeth segments axially separated from one another in each row thereof at four positions, first, on substantial center lines of the tops and bottoms of said intermediate leg portions, in positions substantially 180° opposed to one another and, secondly, in two positions substantially 90° laterally displaced from said first mentioned separations, at substantial center lines of the opposed sides of said intermediate portions, said wedge teeth segments each angling upwardly and radially outwardly from outermost, lesser diameter base portions to innermost, greater diameter portions in said rows, the rows of wedge teeth segments increasing in diameter along the lengths thereof passing from the outermost row of wedge teeth segments to the innermost row of such, a base, outermost portion of each wedge tooth commencing at the innermost greater diameter portion of the tooth outboard thereof or the inner base of the frusto-conical end piece, the top and bottom axial wedge teeth separations each including an elongate, straight groove separating adjacent ends of wedge teeth segments from one another, said axial wedge teeth segment separations positioned at the top and bottom of the legs additionally including beveled, alternately oppositely extending relieved zones on successively outwardly positioned wedge teeth segment ends on each side of said groove, each beveled zone adjacent to and opposite a radial wall on the adjacent wedge segment in a given row thereof across said groove, the wedge tooth segment separations at the sides of the intermediate portions of the outer ends of said manhole step comprising alternate, oppositely extending, beveled reliefs of the said wedge teeth segment ends approaching the side center line, each beveled zone directly next to a radial wall on the adjacent wedge segment in a given row thereof.

2. An improvement as in claim 1 including at least four pressure relief grooves running the substantial length of each of said innermost shoulder portions in a direction extending substantially axially of each respective leg support member, said grooves at least substantially 90° displaced from one another and, further, positioned substantially on center lines of the tops, bottoms and sides of each of said innermost shoulder portions, there being a stop centrally on the bottom of the leg support members having a lead stop portion next to the innermost shoulder portions, one of the grooves on each shoulder portion running to the stop, there being provided a pressure relief channel on the lead stop portion joined by said groove, the relief grooves on the sides of the shoulder portion being provided by beveling the sides of each said shoulder portion to a second and axial wall on the substantial center line of the shoulder portion sides.

3. An improvement as in claim 2 wherein the relief grooves on the two sides of a shoulder portion are provided by beveling in opposite directions to a wall on the center line of the shoulder portion sides.

4. An improvement as in claim 1 including at least two pressure relief grooves running the length of each of said outermost frusto-conical end pieces, said grooves positioned substantially 180° opposed to one another on the top and bottom sides of each said end piece and extending in a direction substantially axial of each respective leg support members, each of said end piece grooves being in substantial axial alignment with the elongate straight groove separating adjacent ends of wedge teeth segments from one another in the top and bottom axial wedge teeth separations.

5. An improvement as in claim 1 including at least four pressure relief grooves running the substantial length of each of said innermost shoulder portions in a direction extending substantially axially of each respective leg support member, said grooves at least substantially 90° displaced from one another and, further, positioned substantially on center lines of the tops, bottoms and sides of each of said innermost shoulder portions, whereby to align themselves with the axial wedge teeth segment separations in the intermediate leg portion.

6. An improvement as in claim 5 wherein there is a stop centrally on the bottom of the leg support members having a lead stop portion next to the innermost shoulder portions, one of the grooves on each shoulder portion running to the stop, there being provided a pressure relief channel on the lead stop portion joined by said groove.

7. An improvement as in claim 5 wherein the relief grooves on the sides of the shoulder portion are provided by beveling the sides of each said shoulder portion to a second and axial wall on the substantial center line of the shoulder portion sides.

8. An improvement as in claim 7 wherein the relief grooves on the two sides of a shoulder portion are provided by beveling in opposite directions to a wall on the center line of each of the shoulder portion sides.

9. In a manhole step construction comprising a U-shape, strong metal reinforcing bar having molded thereover a configured step and supporting leg U shape fully enclosing said bar to make a composite, yet integral, plastic coated, steel core reinforced manhole step body, said body having an elongate, basically straight step portion at the base thereof with two substantially like and symmetrical leg support members extending substantially parallel to one another and at substantial right angles from the ends of said step portion, the free outer ends of said leg support members being adapted to being driven or hammered into paired, spaced apart, inwardly tapered, formed holes in a wall and having three separate, adjacent zones formed on the free ends thereof, said zones including:

(a) an outermost frusto-conical end piece having an inner base, (b) an intermediate, recessed, outwardly tapered leg portion having deflectable wall engaging members thereon and (c) an innermost, outwardly tapering shoulder portion, the improvement which comprises the deflectable wall engaging members comprising a plurality of rows of wedge teeth segments provided on said intermediate portion between said outermost frusto-conical end piece and said innermost outwardly tapering shoulder portion, individual wedge teeth segments axially separated from one another in each row thereof at four positions, first, on substantial center lines of the tops and bottoms of said intermediate leg portions, in positions substantially 180° opposed to one another and, secondly, in two positions substantially 90° laterally displaced from said first mentioned separations, at substantial center lines of the opposed sides of said intermediate portions, said wedge teeth segments each angling upwardly and radially outwardly from outermost, least diameter base portions to innermost, greater diameter portions in said rows, the rows of wedge teeth segments increasing in diameter along the lengths thereof passing from the outermost row of wedge teeth segments to the innermost row of such, a base, outermost portion of each wedge tooth commencing at the innermost greater diameter portion of the tooth outboard thereto or the inner base of the frusto conical end piece, the top and bottom axial wedge teeth separations each including an elongate, straight groove separating adjacent ends of wedge teeth segments from one another, said axial wedge teeth segment separations positioned at the top and bottom of the legs additionally including beveled, alternately oppositely extending relieved zones on successively outwardly positioned wedge teeth segment ends on each side of said groove, each beveled zone adjacent to and opposite a radial wall on the adjacent wedge segment in a given row thereof across said groove, the wedge tooth segment separation at the sides of the intermediate portions of the outer ends of said manhole step comprising alternate, oppositely extending, beveled reliefs of the said wedge teeth segment ends approaching the side center line, each beveled zone directly next to a radial wall on the adjacent wedge segment in a given row thereof, at least two pressure relief grooves running the length of each of said outermost frusto-conical end pieces, said grooves positioned substantially 180° opposed to one another on the top and bottom sides of each said end piece and extending in a direction substantially axial of each respective leg support member, the end piece grooves being in substantial axial alignment with the two wedge tooth segment axial separations and the groove therebetween on the top and bottom sides of each said end piece, at least four pressure relief grooves provided on each of said innermost shoulder portions running the substantial length thereof in a direction extending substantially axial of each respective leg support member, said shoulder portion pressure relief grooves positioned substantially 90° displaced from one another and substantially on center lines of the tops, bottoms and sides of said innermost shoulder portion, the relief grooves on the two sides of said shoulder portions being provided by beveling the sides of each said shoulder portion to a second and axial wall on the substantial center line of the shoulder portion sides, there being a stop centrally on the bottom of each of the leg support members having a leading stop portion next to the innermost shoulder portion, one of the grooves on each shoulder portion running to the stop, there being provided a pressure relief channel on the leading stop portion joined by said groove.

* * * * *